US007112041B2

(12) United States Patent
Debeneix et al.

(10) Patent No.: US 7,112,041 B2
(45) Date of Patent: Sep. 26, 2006

(54) DEVICE FOR PIVOTALLY GUIDING VARIABLE-PITCH VANES IN A TURBOMACHINE

(75) Inventors: Pierre Debeneix, Saint-Sauveur sur Ecole (FR); Arnaud Langlois, Vaux le Penil (FR); Erick Boston, Cesson (FR); Alain Leman, Evry (FR); Vincent Garnier, Sucy en Brie (FR); Jacques Audet, Corbeil (FR)

(73) Assignee: SNECMA Moteurs, Paris (FR)

( * ) Notice: Subject to any disclaimer, the term of this patent is extended or adjusted under 35 U.S.C. 154(b) by 78 days.

(21) Appl. No.: 10/885,778

(22) Filed: Jul. 8, 2004

(65) Prior Publication Data

US 2005/0042079 A1 Feb. 24, 2005

(30) Foreign Application Priority Data

Jul. 10, 2003 (FR) ..... 03 08435

(51) Int. Cl.
*F01D 17/16* (2006.01)

(52) U.S. Cl. ..... 415/162; 415/160

(58) Field of Classification Search ..... 415/160, 415/162

See application file for complete search history.

(56) References Cited

U.S. PATENT DOCUMENTS

| | | | | |
|---|---|---|---|---|
| 2,823,700 | A * | 2/1958 | Christensen | 415/160 |
| 3,496,628 | A | 2/1970 | Davis | |
| 3,966,352 | A | 6/1976 | White et al. | |
| 6,413,043 | B1 * | 7/2002 | Bouyer | 415/160 |

FOREIGN PATENT DOCUMENTS

| | | |
|---|---|---|
| GB | 601 828 | 5/1948 |
| GB | 1 505 858 | 3/1978 |

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

A device for guiding pivoting of variable-pitch vanes in a turbomachine, each vane having a pivot formed by a cylindrical axial shank which is guided in a cylindrical chimney of the casing and in a cylindrical orifice of a stationary element which surrounds the outside of the casing and which is centered and fixed relative thereto. The invention improves pivotal guidance of variable-pitch vanes.

20 Claims, 4 Drawing Sheets

DEVICE FOR PIVOTALLY GUIDING VARIABLE-PITCH VANES IN A TURBOMACHINE

The invention relates to a device for pivotally guiding variable-pitch vanes in a turbomachine such as an aviation turbojet or turboprop.

BACKGROUND OF THE INVENTION

In known guide devices, each vane has one end pivotally mounted on the casing of the turbomachine about a respective axe that is radial relative to the axis of rotation of the rotor, and for this purpose the vanes have respective axial cylindrical shanks forming pivots that are pivotally guided in bearings mounted in radial cylindrical chimneys of the turbomachine casing. These bearings are generally made of bushings of material having a low coefficient of friction, such as sintered bronze, for example.

The axial chimneys of the casing are relatively short in length, such that the vanes, which are subjected to the forces exerted by the flow of gas, tend to tilt obliquely relative to their pivot axes, thereby leading to wear in the guide bushings and in the inside cylindrical surfaces of the chimneys in which the bushings are mounted. This leads to a risk of the vane pivots seizing and to an increase in the force that needs to be applied to the vanes in order to make them pivot about their pivot axes. This also leads to a risk of the radially-inner ends of the vanes coming into contact with the rotor of the turbomachine, and to corresponding risks of damage, destruction, and fire because of the intense heating that arises by the ends of the vanes rubbing against the rotor.

OBJECTS AND SUMMARY OF THE INVENTION

A particular object of the invention is to avoid those drawbacks by providing better pivotal guidance for the pivots of variable-pitch vanes.

To this end, the invention provides a device for pivotally guiding variable-pitch vanes in a turbomachine, each vane having a pivot which is pivotally guided in a cylindrical radial chimney of a casing of the turbomachine and which is connected by a link to a control ring surrounding the casing, wherein the pivot of each of the vanes extends outside the casing beyond the chimney and includes a radially-outer end pivotally guided by a stationary element outside the casing, and wherein the links are secured to the pivots on the vanes between the ends of said pivots, and they support and center the control ring at a distance from the casing.

In this device, the improved pivotal guidance of the variable-pitch vanes is due to the increase in the length over which the vane pivots are guided, thereby reducing the bending moments applied to the vane pivots in their guide means, facilitating pivoting of the vanes about their axes, and avoiding any risk of contact and rubbing between the radially-inner ends of the vanes and the rotor of the turbomachine.

The above-mentioned stationary element is radially spaced apart from the casing, away from the axis of rotation of the turbomachine, by a distance which is greater than the corresponding dimension of the above-mentioned cylindrical chimney, which distance may be about 10 centimeters (cm), for example.

A corresponding advantage of the invention is that the device makes it possible to reduce the length of the cylindrical chimneys which are formed on the casing, thus making the casing easier to manufacture and machine.

Another corresponding advantage of the invention is that the means for guiding the vane pivots outside the casing are further removed from the source of heat formed by the flow of gas in the turbomachine and are thus subjected to a smaller temperature rise.

Consequently, these guide means can be made out of less expensive materials having a low coefficient of friction.

In addition, in the invention, the ring for controlling these vanes is supported and centered around the casing by means of the pivot portions of the vanes which extend outside the casing, thus avoiding any need to center and support said ring directly on the casing of the turbomachine.

In addition, the control ring is at substantially the same temperature as the above-mentioned stationary element so their thermal expansions are of the same order of magnitude, which improves guidance of the control ring. This results in a reduction in the force required to drive the variable-pitch vanes, thus making it possible to use means that are simpler and less expensive for driving these vanes.

According to another characteristic of the invention, the above-mentioned stationary element includes means for pivotally guiding the pivots of a plurality of vanes forming part of the same row of variable-pitch vanes.

In a variant, the stationary element may include means for pivotally guiding the pivots of all of the vanes in the same row of variable-pitch vanes.

In another variant embodiment, the stationary element includes means for pivotally guiding the pivots of all of the vanes forming parts of two successive rows of variable-pitch vanes.

In an embodiment, the above-mentioned stationary element is annular in shape extending around the casing over about 360°.

The stationary element is then preferably a single-piece element and it also reinforces the rigidity of the turbomachine casing.

In another embodiment, this stationary element is made up of a plurality of optionally consecutive annular segments each of which is fixed to the casing.

BRIEF DESCRIPTION OF THE DRAWINGS

The invention will be better understood and other characteristics, details, and advantages thereof will appear more clearly on reading the following description given by way of example and made with reference to the accompanying drawings, in which.

MORE DETAILED DESCRIPTION

Figure 1:
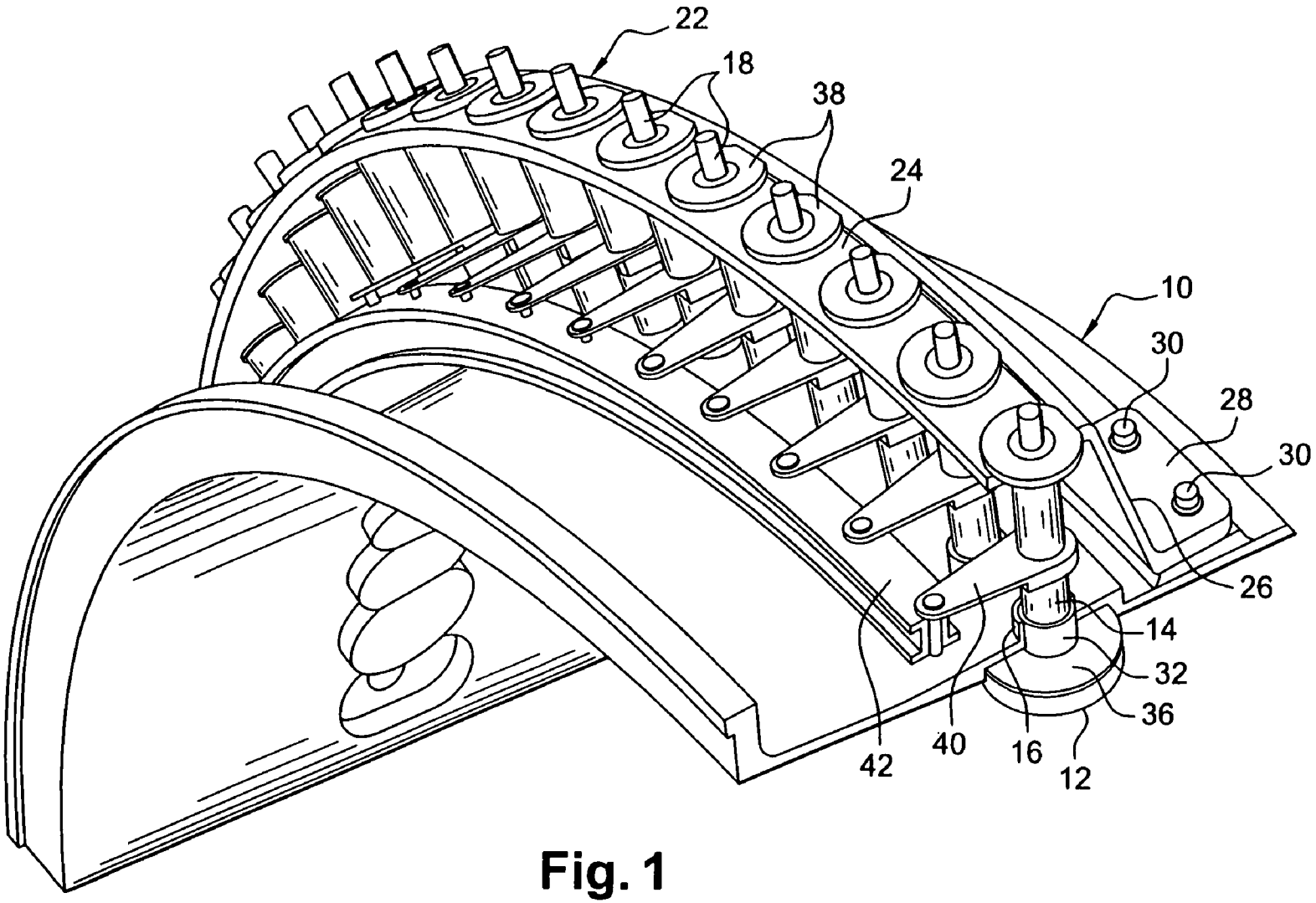
FIGS. 1 and 2 are fragmentary diagrammatic perspective views on different scales showing a first embodiment of the device of the invention.
Figure 2:
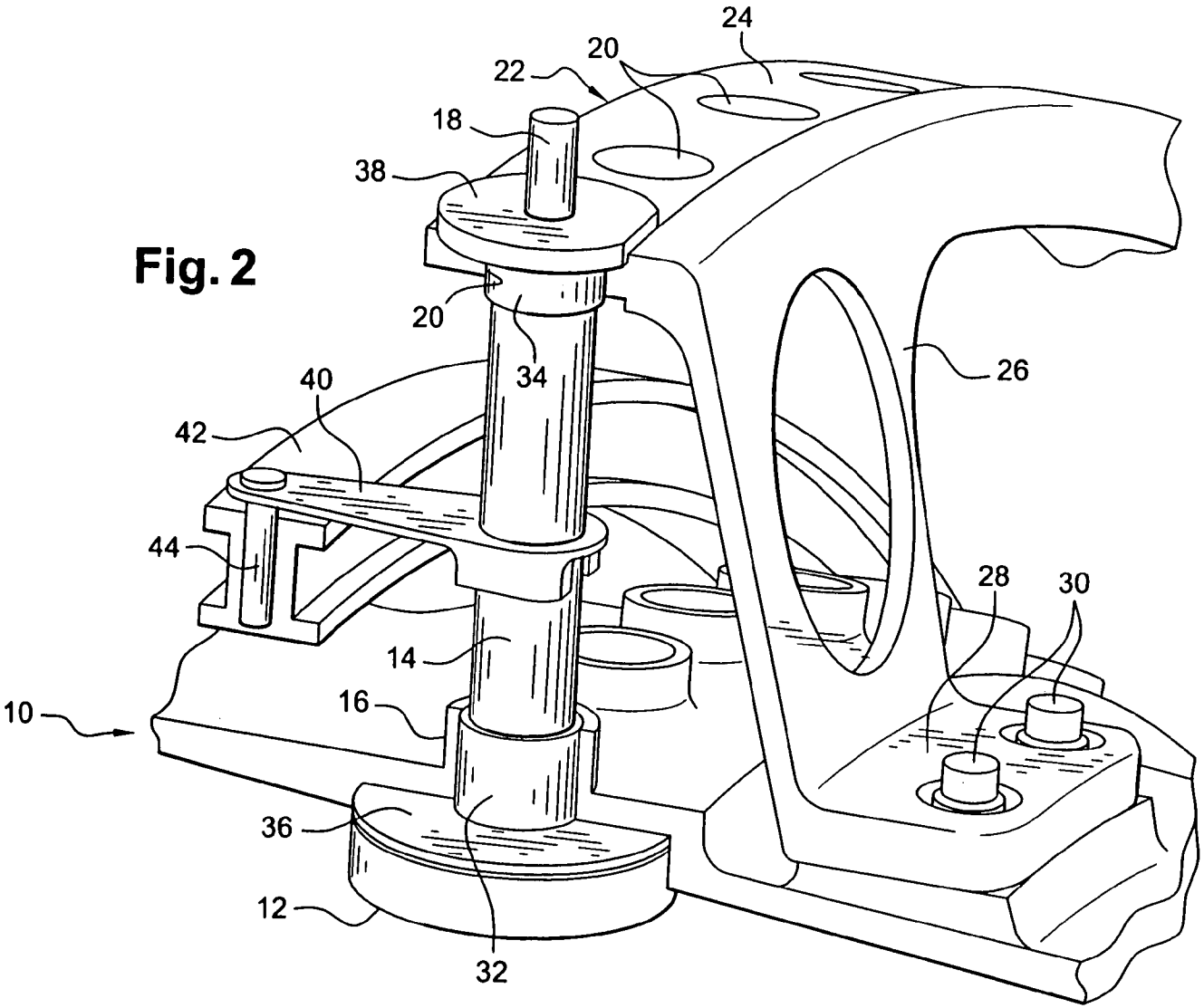

In FIGS. 1 and 2 which show a first embodiment of the invention, reference 10 designates a turbomachine casing that is generally cylindrical in shape and that is centered on the axis of rotation of a rotor of the turbomachine.

The turbomachine comprises one or more stator stages formed by gas flow guide vanes 12, these vanes being mounted on the casing 10 to pivot about axes that are radial relative to the axis of rotation of the rotor, and only the radially-outer portions thereof or "vane roots" being shown in the drawings.

Each vane 12 includes a cylindrical axial shank 14 extending inside a radial cylindrical chimney 16 of the casing 10 and having a radially-outer end portion 18 extending beyond the chimney 16 and which is pivotally guided in a cylindrical orifice 20 of a stationary element 22 which surrounds the casing 10 on the outside and at a distance therefrom.

In the embodiment shown, the stationary element 22 comprises a cylindrical wall 24 centered on the axis of rotation of the rotor of the turbomachine with the above-mentioned orifices 20 being formed therein, and with fixing tabs 26 extending from said cylindrical wall 24 towards the casing and terminating in lugs 28 receiving screws 30 for fastening to the casing 10.

The stationary element 22 may be in the form of a continuous or substantially continuous annulus extending over about 360° around the longitudinal axis of the casing. The fixing tabs 26 are formed at regular intervals on the element 22, and when it is fastened to the casing the element reinforces the stiffness of the casing.

In a variant embodiment, the stationary element 22 may be constituted by two semicylindrical elements each extending over about 180° and disposed end to end on the casing 10.

In another variant, the stationary element 22 may be made up of a plurality of annular segments disposed end to end around the casing 10.

The axial shanks 14 of the vanes 12 are guided in the cylindrical chimney 16 of the casing and in the cylindrical orifices of the stationary element 22 by means of smooth bearings which are constituted, for example, by respective cylindrical bushings 32, 34 and by respective washers 36, 38 made of a material having a low coefficient of friction.

In the example shown, the washer 36 associated with the bushing 32 is on the inside of the casing 10, while the washer 38 associated with the bushing 34 is radially on the outside of the cylindrical portion 24 of the stationary element.

As can be seen in FIGS. 1 and 2, that portion of the cylindrical axial shank of the vane which extends beyond the vane root 12 is relatively long and extends well beyond the cylindrical chimney 16 of the casing, with the increase in the guidance length of the cylindrical axial shank 14 of the vanes being about 100% to 200% compared with the prior art when using the device of the invention.

Since the cylindrical bushing 34 and the washer 38 for guiding pivoting of the vane in the stationary element 22 are relatively far away from the casing 10, they are subjected to lower temperatures than the bushing 32 and the washer 36, and can therefore be made out of low-cost material.

The intermediate portion of the cylindrical axial shank 14 of each vane extending between the cylindrical chimney 16 and the stationary element 22 is used advantageously for fixing a link 40 for connection to a control ring 42 which extends around the casing 10 and which is itself associated with actuator means (not shown) enabling it to be turned in one direction or the other about the longitudinal axis of the casing 10 in order to cause the vanes 12 to pivot about their pivots 14.

In more detail, each link 40 is fixed securely at one end to the pivot 14 of a vane 12, while its other end is hinged to the control ring 42 about a radial axis embodied by a pin 44.

An advantage of the device of the invention is that the control ring 42 is carried by the links 40 which are themselves secured to the pivots 14 of the vanes 12, thus avoiding the use of other means for supporting and centering the control ring 42 on the casing 10.

Furthermore, the control ring 42 is thus held at a distance from the casing 10 so its thermal expansion will be comparable to that of the stationary elements 22, thus making it easier to guide the control ring 42 and simplifying its actuator means.

Figure 3:
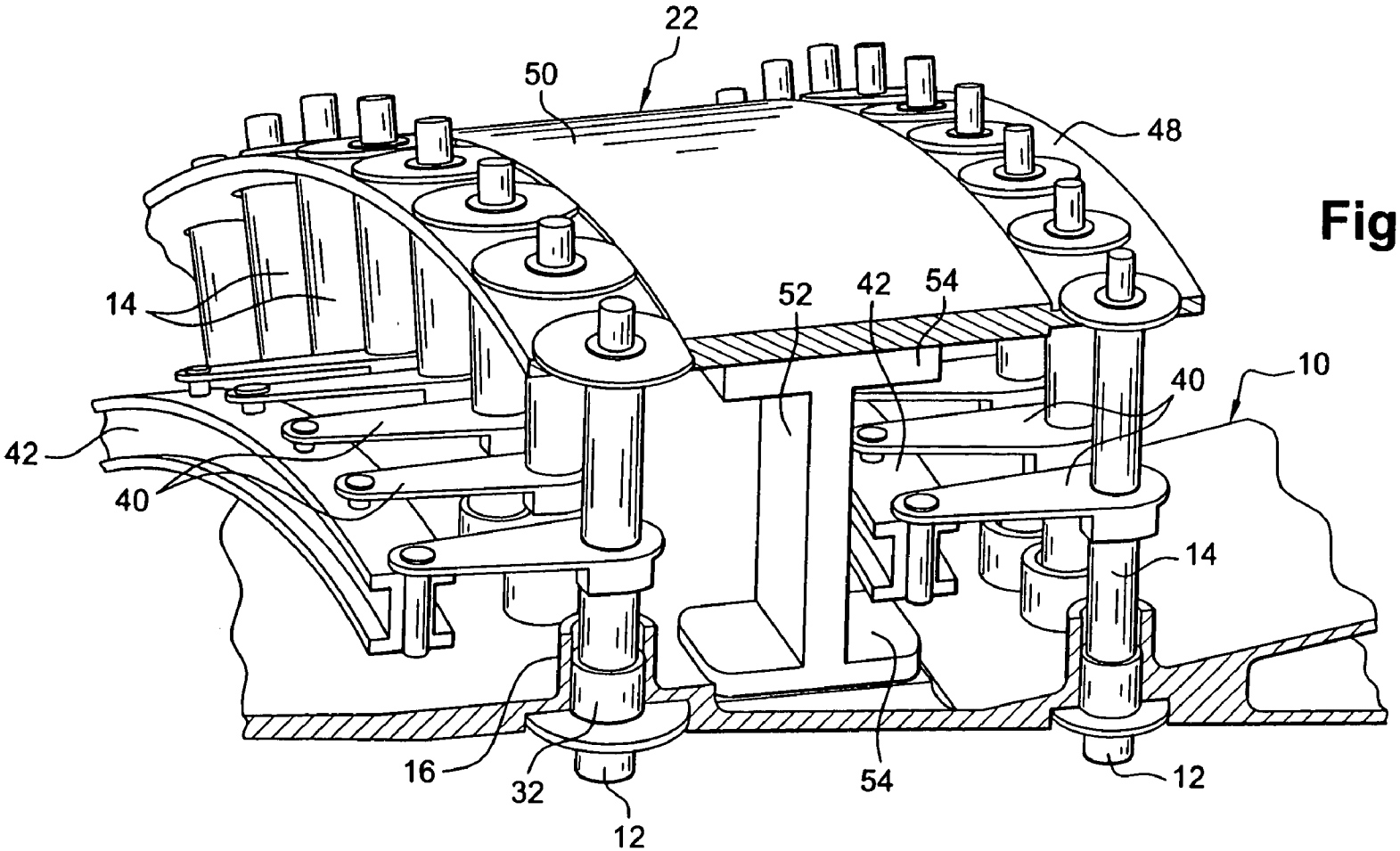
FIG. 3 is a fragmentary diagrammatic perspective view showing a variant embodiment of the device.

In the embodiment shown in FIG. 3, the same stationary element 22 serves to guide the vanes 12 in pivoting for two consecutive rows of variable pitch vanes whose pivots formed by the cylindrical axial shanks 14 are guided in cylindrical chimneys 16 of the casing and in cylindrical orifices in two side margins 48 of the stationary element 22, margins which project from either side of a cylindrical wall 50, which is itself supported by and secured to the casing 10 by fixing tabs 52 that are regularly distributed around the longitudinal axis of the casing 10.

In this embodiment, the tabs 52 have lugs 54 at their radially-inner and radially-outer ends, enabling them to be fixed to the casing 10 and to the cylindrical portion 50 of the stationary element 22.

The means for pivotally guiding the pivots 14 in the cylindrical bushings 16 of the casing and in the cylindrical orifices of the stationary element 22 are the same as those described above and shown in FIGS. 1 and 2.

In addition, as in the embodiments of FIGS. 1 and 2, the pivots 14 of the variable-pitch vanes in each row are connected by links 40 to a respective control ring 42 surrounding the outside of the casing 10 and supported and centered by the links 40, themselves secured to the pivots 14. The two control rings 42 shown in FIG. 3 are parallel and situated at the same distance from the longitudinal axis of the casing 10, the links 40 of the two rows of variable-pitch vanes being oriented in the same direction so that the control ring 42 shown in the right-hand portion of FIG. 3 lies under the cylindrical central portion 50 of the stationary element 22 in the vicinity of its fixing tabs 52, while the other control ring 42, shown in the left-hand portion of FIG. 3, lies outside the stationary element 22.

Figure 4:
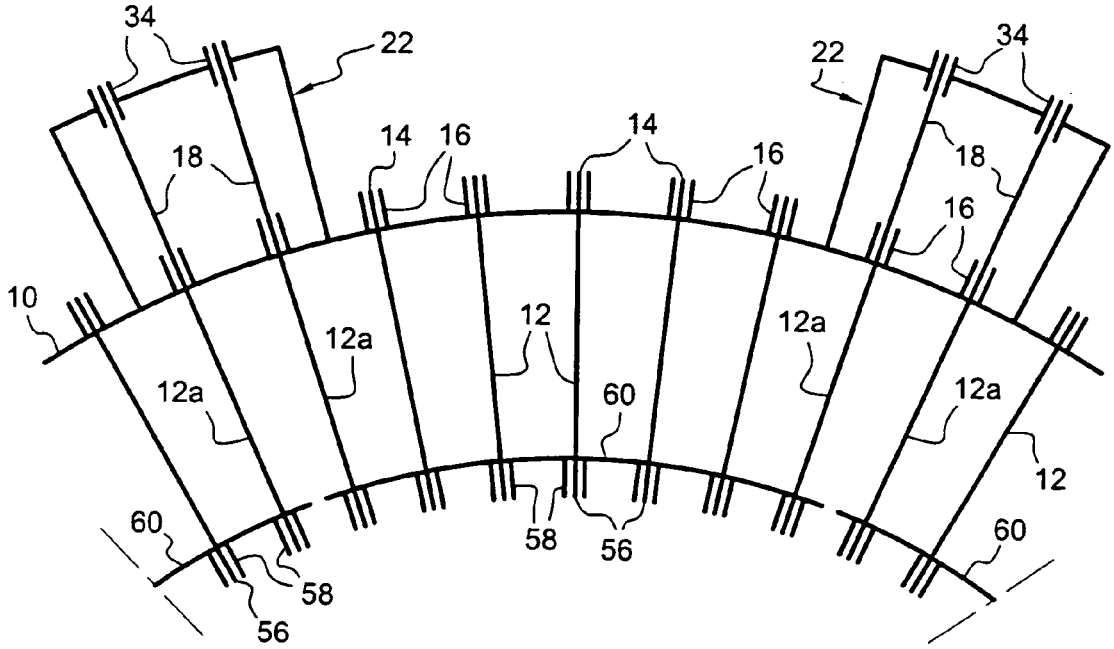
FIG. 4 is a fragmentary diagrammatic view showing a variant embodiment of the invention.

FIG. 4 is a diagram showing a variant embodiment in which the radially-inner pivots 56 of the vanes 12 in a given row are guided in cylindrical bushings 58 carried by radially-inner ring sectors 60 which extend around the axis of rotation one after another.

Each inner sector 60 guides the inner pivots 56 of some number of vanes 12, where this number can be about a dozen, for example.

The end vanes 12*a* in each group of vanes 12 carried by the same inner ring sector 60 have radially-outer pivots 14 that are extended so that their outer ends are guided in bushings 34 of an outside stationary element 22 as described above. The outer pivots 14 of the vanes 12 that are situated between the end vanes 12*a* in each group are not extended outwards and are guided solely in the cylindrical chimneys 16 of the casing 10, as shown.

The end vanes 12*a* in each group may comprise one vane at each end, as shown, or a plurality of vanes.

These end vanes 12*a* take up the bending moments applied to the vanes 12 of the group and may themselves be reinforced, e.g. of increased thickness and/or made of a material that is stronger than the other vanes in the group, which do not have to take up the above-mentioned bending moments.

What is claimed is:

1. A device for pivotally guiding variable-pitch vanes in a turbomachine, each vane having a radially outer pivot which is pivotally guided on a casing of the turbomachine and which is connected by a link to a control ring surrounding the casing, the pivot of each vane having a radially-inner portion which is pivotally guided in a cylindrical radial chimney of the said casing and a radially-outer end which is pivotally guided by a stationary element outside the casing, wherein the link connected to the control ring is secured to the pivot of the vane between the chimney and the stationary element and the control ring is supported and centered around the casing and at a distance from the casing by the links secured to the pivots of the vanes.

2. A device according to claim 1, wherein said stationary element is radially spaced apart from the casing relative to the axis of rotation of the turbomachine by a distance which is greater than the corresponding dimension of the above-mentioned chimney.

3. A device according to claim 1, wherein the stationary element includes means for guiding pivoting of the pivots of a plurality of vanes making up part of a single row of variable-pitch vanes.

4. A device according to claim 1, wherein the stationary element includes means for guiding pivoting of the pivots of all of the vanes in the same row of variable-pitch vanes.

5. A device according to claim 1, wherein the stationary element includes means for guiding pivoting of the pivots of all of the vanes of two consecutive rows of variable-pitch vanes.

6. A device according to claim 1, wherein the stationary element is annular in shape and extends around the casing over about 360°.

7. A device according to claim 1, wherein the stationary element is a single-piece element.

8. A device according to claim 1, wherein the stationary element is made up of a plurality of annular segments secured to the casing.

9. A device according to claim 1, wherein the radially-outer end of each pivot is guided in pivoting by means of a bearing mounted in a cylindrical orifice in the stationary element.

10. A device according to claim 9, wherein the bearing is a bearing made of a material having a low coefficient of friction.

11. A device according to claim 1, wherein said stationary element is supported and centered on the casing by means of fixing tabs which are distributed regularly around the longitudinal axis of the casing.

12. A device according to claim 1, wherein the radially-inner ends of the vanes of a row include pivots that are guided and interconnected by radially-inner annular sectors.

13. A device according to claim 12, wherein each radially-inner ring sector carries the radially-inner pivots of a group of the above-specified vanes, and the radially-outer pivots of the end vanes in each group are guided by an above-mentioned stationary element outside the casing, while the radially-outer pivots of the vanes situated in-between the end vanes of each group are guided solely in the radial chimneys of the casing.

14. A device according to claim 13, wherein, in each group, the end vanes are made of a material that is stronger than that of the vanes situated between said end vanes.

15. A device for pivotally guiding a variable-pitch vane in a turbomachine, comprising:

a control ring surrounding a casing of the turbomachine;

a variable-pitch vane having a radially outer pivot which is pivotally guided on the casing and which is connected by a link to the control ring, the pivot of the vane having, a radially-inner portion which is pivotally guided in a cylindrical radial chimney of the casing, and a radially-outer end which is pivotally guided by a stationary element outside the casing, wherein the link connected to the control ring is secured to the pivot of the vane between the chimney and the stationary element, and the control ring is supported and centered around the casing and at a distance from the casing by the link secured to the pivot of the vane.

16. A device according to claim 15, further comprising the casing of the turbomachine.

17. A device according to claim 15, wherein the stationary element includes means for guiding pivoting of the pivots of a plurality of vanes making up part of a single row of variable-pitch vanes.

18. A device according to claim 15, wherein the stationary element includes means for guiding pivoting of the pivots of all of a plurality of vanes in a same row of variable-pitch vanes.

19. A device according to claim 15, wherein the stationary element includes means for guiding pivoting of the pivots of all of a plurality of vanes of two consecutive rows of variable-pitch vanes.

20. A device according to claim 15, wherein the stationary element is annular in shape and extends around the casing over about 360°.

* * * * *